US005477600A

United States Patent [19]

Houle et al.

[11] Patent Number: 5,477,600

[45] Date of Patent: Dec. 26, 1995

[54] SNOW PLOW WITH DEFORMABLE MOLDBOARD

[75] Inventors: Bertrand Y. Houle; Guy P. Lamoureux, both of Drummondville; Luc J. Guertin, St-Thomas D'Aquin, all of Canada

[73] Assignee: Tenco Machinery Ltd., St. Valerien, Canada

[21] Appl. No.: 158,863

[22] Filed: Nov. 29, 1993

[51] Int. Cl.[6] ..... E01H 5/06

[52] U.S. Cl. ..... 37/279; 37/233; 37/266; 172/823

[58] Field of Search ..... 37/216, 232, 233, 37/266, 274, 275, 279, 281, 283; 172/822, 823

[56] References Cited

U.S. PATENT DOCUMENTS

| | | | |
|---|---|---|---|
| 4,254,564 | 3/1981 | Rath | 37/283 X |
| 4,837,951 | 6/1989 | Verseef | 37/197 |
| 5,018,284 | 5/1991 | Mikami et al. | 37/233 |
| 5,025,577 | 6/1991 | Verseef | 37/266 X |
| 5,079,866 | 1/1992 | Farrell | 37/283 |

*Primary Examiner*—Randolph A. Reese
*Assistant Examiner*—Andrea Chop

[57] ABSTRACT

A deformable plow operates off of at least one hydraulic cylinder that extends from a post on the plow frame to a guide bar positioned along the upper edge of a plastic or deformable moldboard.

16 Claims, 8 Drawing Sheets

SNOW PLOW WITH DEFORMABLE MOLDBOARD

FIELD OF THE INVENTION

This invention relates to snow plows wherein the moldboard may be deformed to provide either a reversible or one-way plow configuration. More particularly, it relates to a mechanical arrangement for effecting such deformation.

BACKGROUND OF THE INVENTION

Snow plows, until recently, have been classified as being either "one-way" plows or "reversible". A one-way plow has a non-symmetrical, funnel-shaped configuration that permits snow to be thrown outwardly and upwardly from one side of the plow. In the past, such plows have been committed by their fixed structure to a single side operation. Further, such plows are used only in an angled format which prevents them from being used to pile snow in the forward direction.

A "reversible" plow is symmetrical, usually rectangular in shape. Such plows can be set perpendicular to their line of travel to allow snow to be forwardly piled. Alternately, they may be angled to either side so as to scrape snow continuously off to one side. Lacking a conical or funnel-like shape, a reversible plow is not able to throw snow in the manner of a one-way plow.

As both formats of plow are often needed, it would be highly desirable to have a reversible plow that could readily function in the manner of a one-way plow. This, however, would require a snow plow with a moldboard which can be changed in shape.

For optimal operation, the surface of a one-way plow should be funnel-like in character. Towards the center of the road (furthest from the side or ditch where snow will be thrown) the plow need not be high. The snow received can be met by a relatively vertical and substantially curved moldboard surface which, combined with the retiring, angular orientation of such surface, will induce the snow to flow laterally towards the ejection end of the plow.

While this process of receiving and deflecting snow is occurring evenly across the entire front width of the plow, more and more snow is present in proceeding across the moldboard surface towards the ejection end. Further, for ideal operation, it is desirable for such snow to acquire both a sideways and an upwards velocity. This is in addition to the forward velocity that the snow acquires by reason of having been picked-up by the forward moving snow plow blade. The upwards velocity acquired by the snow, combined with its sideways velocity, will maximize the distance that the snow is thrown, once it is ejected from the plow. This is of great value as the further the snow is thrown, the less likely it is that it will have to be moved a second time on a further plowing. Also, well thrown snow is more likely to clear banks of snow that may accumulate on the sides of a roadway.

Balanced against all of the foregoing considerations is the need to minimize the amount of materials to be committed to forming the snow plow structure. A heavy plow is expensive to build and operate. An ideal combination reversible/one-way plow should be able to readily change from a symmetrical form to a funnel-like configuration without the presence of complex structural systems.

It has long been known to provide deflector plates along the upper edge of snow plow blades to prevent snow from over-flowing over the top of such blades. Examples include the following U.S. Pat. Nos.:

1,900,703 to Frink
1,926,011 to Soule
2,160,972 to Litchy
2,160,973 to Litchy
4,459,769 to Willis.

Attempts have also been made to introduce a rough approximation of variable curvature into the surface of a scraper blade, vis U.S. Pat. No. 4,019,587 to Meisel in respect of an earth moving bulldozer blade.

U.S. Pat. No. 3,466,767 to Rubin describes a flexible-arc deflector for use on a snow thrower that may also be tilted to the left or right to improve the projection of snow.

In the snow plowing field, U.S. Pat. No. 4,254,564 to Rath has proposed elevating the alternate ends of an overhanging deflector portion on a reversible plow so as to improve its snow ejection efficiency and achieve, at least partially, the benefits of a one-way plow.

More recently U.S. Pat. Nos. 4,837,951 and 5,025,577 to Verseef have proposed deforming the upper portion of a flexible moldboard so as to obtain similar benefits to those sought by Rath. Both of these latter patents rely upon arcurate arms (mounted behind the moldboard) that are extended upwardly to tilt their upper ends forward in the direction of travel of the plow, carrying the outer corners of the moldboard along a similar path.

U.S. Pat. No. 5,079,866 to Farrell achieves a similar effect by a mechanism which couples a pair of spaced apart accurate, moldboard deforming arms to the mechanism for controlling the sideways, angled geometry of the plow. The result is to simultaneously deform the moldboard into one-way curvature when the blade is angled either to the right or left. Again, as with Verseef, Farrell relies upon use of rearwardly mounted, preformed arms that are curved in a fixed configuration to serve as ribs in supporting the outer ends of the moldboard and to position the respective outer ends of the moldboard to produce the desired contour.

Verseef operates by manipulating directly the upper, outer corners of the moldboard. Farrell endeavours to control the alignment of the upper edge of the moldboard by positioning a centrally suspended tubular moldboard "retention strip", that engages the top edge of the moldboard, with his two laterally placed accurate arms.

In both Farrell and Verseef, the accurate arms shift alternate sides of the top portion of the moldboard either forward and downward or upwards and backwards. In both cases, the controlling arms are separately supported on a frame which lies behind the moldboard and extends across the width of the plow. Such arms provide backing and support for the moldboard, simultaneously at both sides of the plow. There is no teaching in either patent about the preferred path that the upper edge of the moldboard should follow in being deformed from one configuration to another.

Against this background it would be desirable to provide a simpler structure and mechanism for controlling the contour of a deformable moldboard for reversible snow plows.

A further desirable objective in designing a snow plow with a deformable moldboard is that such moldboard should be mounted in such a way as to minimize stresses that arise from the when changing its contours from one shape to another.

It is with the foregoing objects and considerations in mind that the inventors herein have arrived at the present invention.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention may be generally summarized as being a moldboard assembly for a reversible snowplow having a deformable moldboard comprising at least one moldboard-shaping control arm that extends laterally from a portion of the frame supporting the moldboard to a point along one side of the upper portion of the moldboard so as to provide a means by which the upper edge of the moldboard may be twisted into the desired shape. To assist in stabilizing the twisting of the upper edge of the moldboard, this upper edge may be constrained to swing about a joint. Conveniently, this joint may be positioned centrally within the frame, rearwardly of the upper edge of the moldboard.

In one variant of the invention the joint may provide a forwardly directed axis of rotation that is elevated from the horizontal plane. In another variant, the joint may be of a universal or swivel type.

More particularly, such a moldboard assembly may comprise:

(a) a supporting frame having:
  (i) a lower moldboard support for mounting a moldboard by its lower edge on the forward side of such frame; and
  (ii) an elevated, central, support post for carrying at its upper end a joint means;

(b) a deformable moldboard, in the form of a resilient, flexible sheet having forward and rearward surfaces and upper and lower edges, such moldboard being mounted on such frame with the lower edge of the moldboard positioned along the lower moldboard support;

(c) a guide bar positioned along the upper portion of the moldboard for supporting and aligning the upper edge of the moldboard;

(d) joint means supported by the central support and connected to the guide bar to permit the guide bar to rotate in both the horizontal and vertical directions; and (e) extensible guide bar positioning means extending rearwardly from a lateral portion of the guide bar to the frame, preferably at a point on the central support post, whereby the extension of the guide bar positioning means will advance and depress one end of the guide bar while simultaneously raising and retiring the other end of the guide bar so as to deform the shape of the moldboard surface. To achieve this it is convenient to connect the positioning means to the central support post at a position located rearwardly and above the height of the joint means.

In one variant of the invention the guide bar positioning means comprises two hydraulically activated pistons disposed symmetrically about the central support post. Preferably the hydraulically activated pistons are interconnected through a lock valve.

In another variant of the invention the guide bar comprises:

(a) a longitudinal slot into which the top edge of the moldboard is interfitted; and (b) a pair of hinges connecting the moldboard to the guide bar at the respective outer ends of the guide bar, such hinges providing for lateral movement of the moldboard within the longitudinal slot.

As a further alternate version of the invention the frame comprises a moldboard backup support positioned along the rearward side of at least the lower portion of the moldboard, the forward facing shape of such backup support conforming to the shape naturally taken by at least the lower portion of the rearward surface of the moldboard when the pivot bar is elevated to its upper limit.

Further, the guide bar is preferably limited by the orientation of the guide bar positioning means to swing along a path which causes the moldboard to deform with minimal buckling, and to separate from the backup support to the minimum extent consistent with the avoidance of buckling.

As an additional feature of the invention, the central support post is provided with a central moldboard support surface that contacts at least the lower half of the rear surface of the moldboard and conforms in shape to the shape naturally taken by such lower half of the rearward surface of the moldboard as it contacts the central post when the guide bar is horizontal. Alternately, this shape may be that which occurs at the central post when the guide bar is elevated at one end to its upper limit.

As another useful feature, the moldboard may be contained between the moldboard edge support member, the backing support member, and the moldboard containment means without the use of fastening members that require perforations to be formed in said moldboard along its lower edge. Further, the guide bar may be displaceable along a path which maintains the containment of the moldboard.

The foregoing summarizes the principal features of the invention and some of its optional aspects. The invention may be further understood by the description of the preferred embodiments, in conjunction with the drawings, which now follow.

DESCRIPTION OF PREFERRED EMBODIMENT

Figure 1:
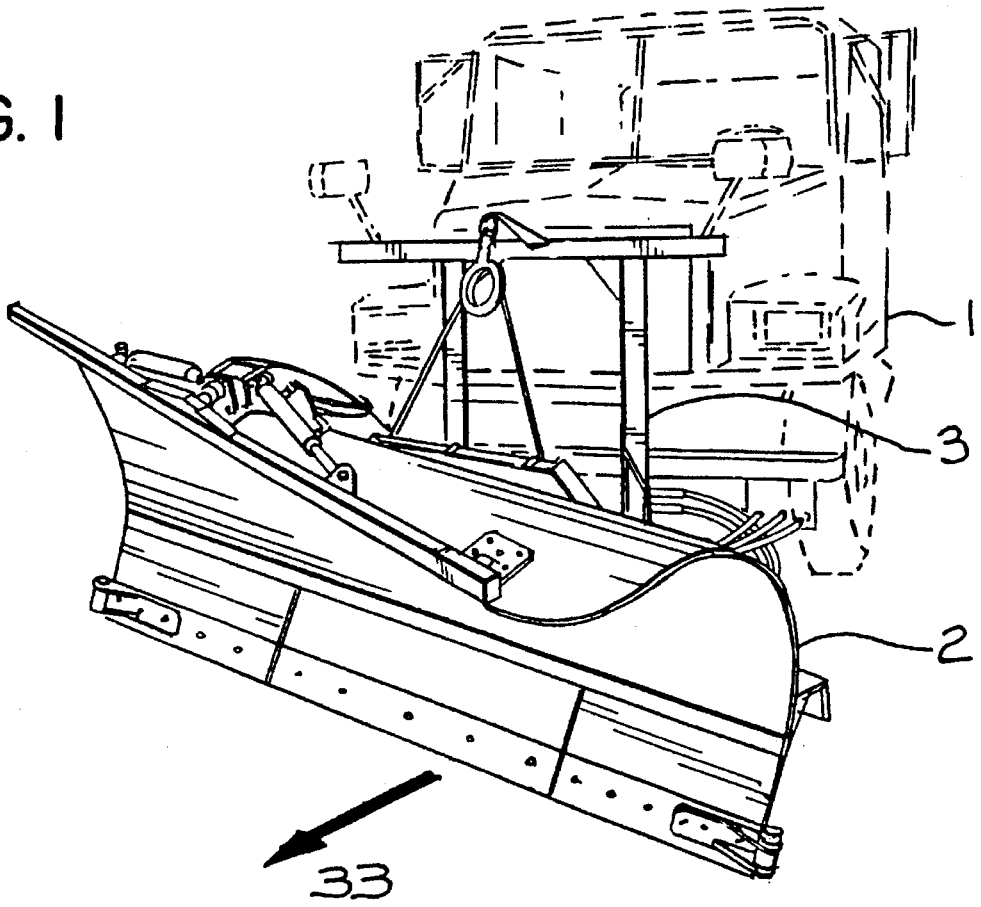
FIG. 1 is a front view of a truck equipped with a snow plow according to one version of the invention wherein two hydraulic cylinders are employed to deform the moldboard.

In FIG. 1 a truck 1 carries a snow plow 2 at its front end. The truck has mounted forward of its front bumper a plow carrier 3 in the form of a standard truss with adjustable linkages for raising and lowering the plow 2, for angling the plow 2 to either side, and to control the angle of attack of the plow 2. The forward direction is indicated by an arrow 33.

Figures 2, 2A:
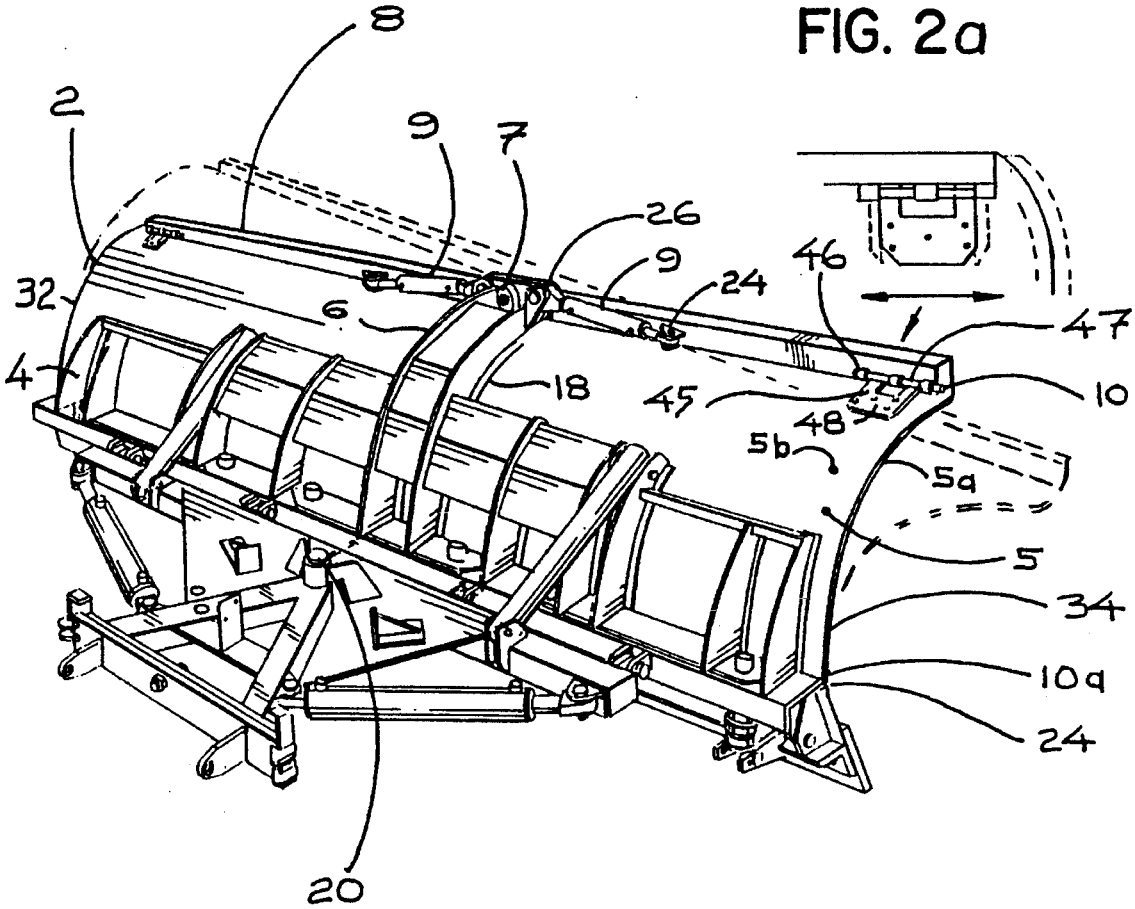
FIG. 2 is a perspective view of the snow plow of FIG. 1 in two-way configuration taken from the rear right-hand quarter with the one-way configuration shown in ghost outline.
FIG. 2*a* is a detail of the sliding attachment of the guide bar to the hinge on the moldboard.

In FIG. 2, the plow 2 with its moldboard assembly is shown in perspective from the right rear quarter. This moldboard assembly includes a frame 4, a moldboard 5 and the structures which will allow the operator to deform the shape of the moldboard surface. These include a central post 6 extending upwardly from the frame 4 and carrying at its upper end a joint 7; a guide bar 8 mounted along the upper portion of the moldboard 5, and at least one hydraulic cylinder 9 extending between the guide bar 8 and the central post 6. In the variant of FIG. 2, the joint 7 is a universal or swivel joint.

The moldboard 5 is formed from a resilient, flexible sheet of material, preferably made of a tough polymeric material such as high density polypropylene. The moldboard 5 has forward and rearward surfaces **5*a*, 5*b*, and top and bottom edges 10, 10*a***.

Figure 3:
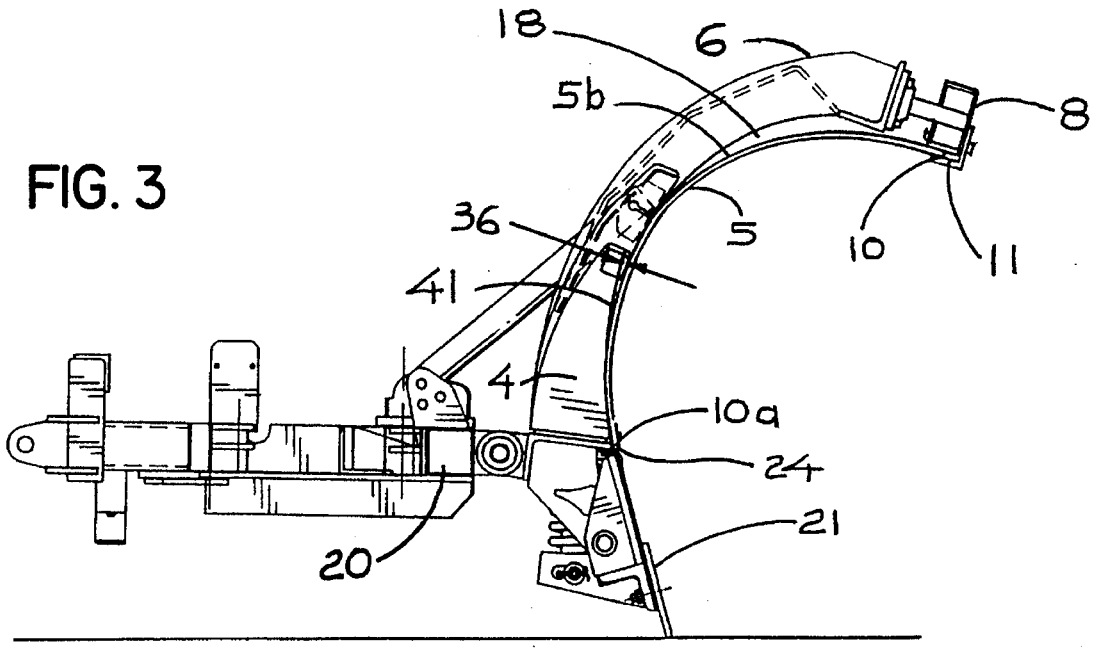
FIG. 3 is a side view of the plow in reversible, two-way format, omitting the hydraulic cylinders.

The lower edge **10*a* of the moldboard 5 is seated in a slot or groove 24 formed on the forward side of the frame 4, as shown in FIG. 3. This groove 24 allows the moldboard 5 to be contained and supported along its lower edge 10*a* without the use of bolts or other fasteners which would pierce the moldboard 5. This has the advantage of allowing the moldboards 5 to absorb shocks without tearing. This is done by sliding the moldboard 5 upwardly slightly within groove 24. The top edge 10 of the moldboard 5 carries a guide bar 8**.

The guide bar 8, seen in end view in FIG. 3, may be tubular to provide stiffness. Its function is to support and align the upper edge 10 of the moldboard. Although shown as mounted along the edge 10, it may be mounted at a spaced distance back from the edge 10, so long as it meets its functional requirements.

The guide bar 8 in the preferred embodiment has a longitudinal slot 11 into which the edge 10 fits and is contained. In one variant of the invention, this containment of the edge 10 allows the moldboard 5 to be held in place in a manner which still allows a degree of relative lateral movement between the moldboard 5 and guide bar 8.

As the moldboard 5 deforms, the top edge 10 will tend to shear laterally in the slot 11. For an 11 foot wide moldboard 5, this motion will only be about 1–2 inches. By extending the guide bar 8 and capping its ends, this motion can be permitted to occur while still retaining the moldboard in position. This arrangement permits the moldboard 5 to remain unperforated.

Alternately, as shown in FIG. 2, hinges 45 may be loosely mounted near the ends of the guide bar 8, being mounted by bolts through the upper portion of the moldboard 5. Lateral motion can be provided by using a guide bar attachment 46 to receive the hinge pin 47 that provides room for a partial sliding displacement of the guide bar attachment 46 with respect of the hinge counter-part 48 along hinge pin 47.

Figure 9:
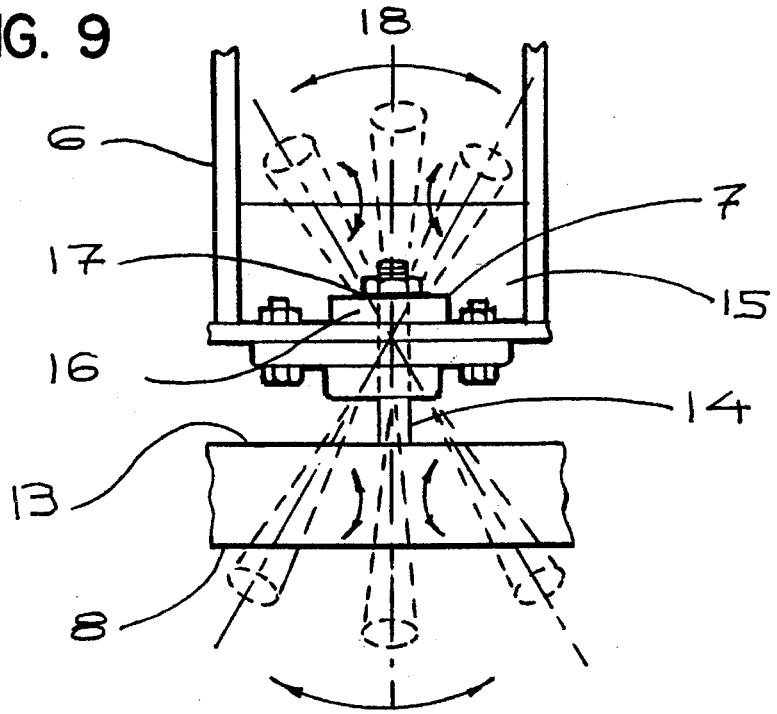
FIG. 9 is a close-up cutaway view of the swivel joint showing its range of angular freedom.

The guide bar 8 of the embodiment of FIG. 2 is supported by a swivel joint 7 set into the central post 6. As shown in FIG. 9 this joint 7 can conveniently be connected to the guide bar 8 by welding a bolt 14 to the inner side 13 of the guide bar 8. This bolt 14 extends into a housing 15 on the central post 6 and passes through a rubber and fiber pad 16 which is mounted around its periphery to the inner surfaces of the housing 15. Nuts with washers 17 clamp the bolt 14 to the pad 16.

This joint 7 serves as a universal joint and support for the guide bar 8, allowing the guide bar 8 to rotate, to a limited degree, in both the vertical and horizontal directions. The cone of freedom 18 of the axis of the bolt 14 is shown in broken outline in FIG. 9.

The central post 6 supporting the joint 7 extends upwardly from the frame 4 as shown in FIGS. 2, 3, 4 and 10, and is inclined forwardly to overlie the moldboard 5. The forward surface 18 of the central post 6 is optionally shaped to support the moldboard 5 in certain of its configurations.

The central post 6 extends upwards from a frame 4 which lies behind at least the lower portion of the moldboard 5, preferably at least the lower half. The forward side 41 of the frame 4 is shaped to support the rearward surface **5*b* portions of the moldboard 5 which will lie against the frame 4 according to certain of the contoured shapes that the moldboard 5 will adopt. This frame 4 is itself carried on a pivot 20 that will allow it to be swung to the left and right. As well, a standard tripping edge scraper blade 21 is mounted along the bottom of the frame 4** at its forward face to lift snow from the road surface.

Figure 5:
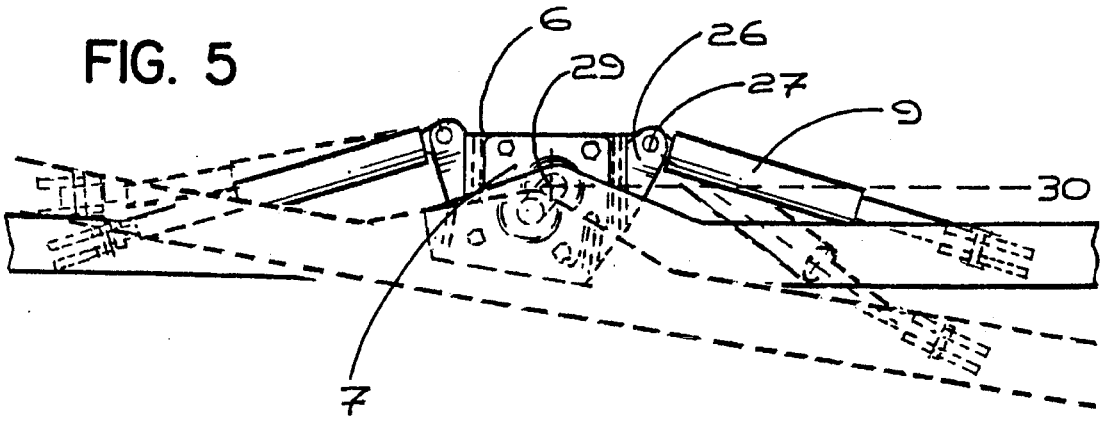
FIG. 5 is a front view of the top of the moldboard assembly facing the swivel joint with the plow in reversible format, with a ghost outline for a one-way format superimposed.
Figure 6:
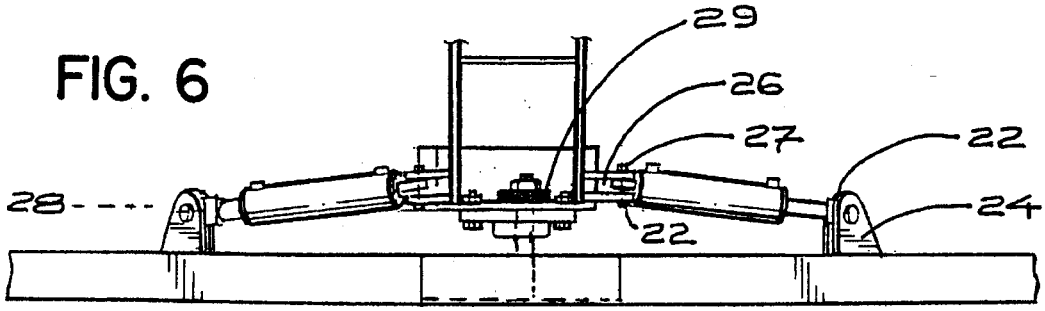
FIG. 6 is a top view of FIG. 5.
Figure 7:
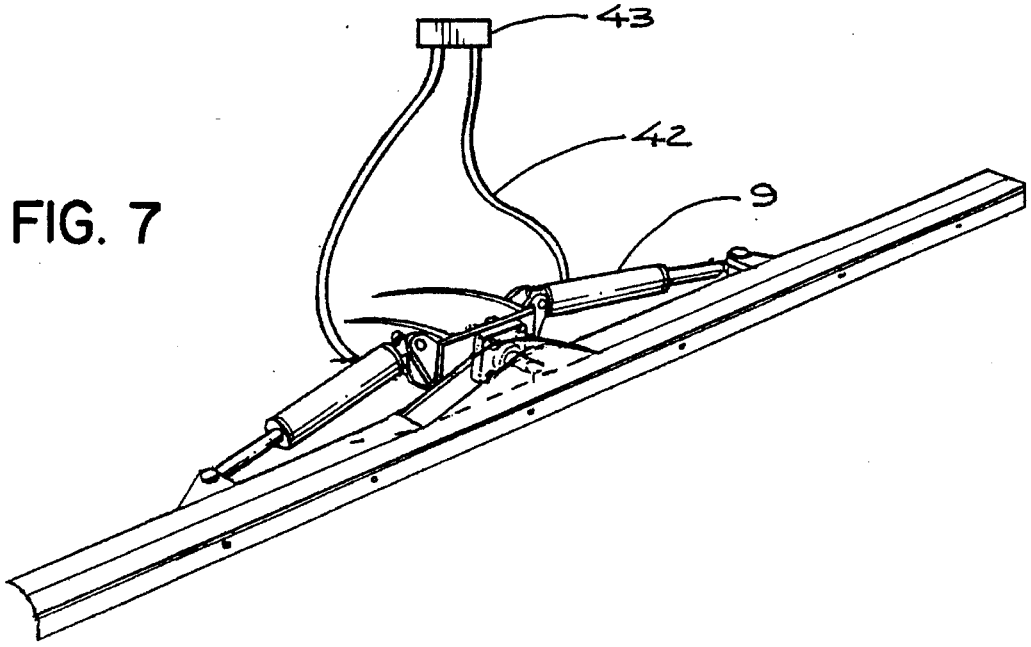
FIG. 7 is a perspective view of FIGS. 5 and 6.

The contour of the moldboard 5 is controlled by displacing the guide bar 8 in a preferred manner, as best seen in FIGS. 5, 6 and 7. This is effected by at least one hydraulically powered cylinder and piston 9 that extends from the central post 6 to the guide bar 8. This cylinder and piston 9, bed fluid through a hose 42, is attached through couplings 22 at its ends to both the guide bar 8 and the central post 6. At least one of these couplings 22 may be universal or freedom within the coupling may be provided by the cylinder and piston 9. In the case of the guide bar 8, this coupling may conveniently be effected through flanges 24 extending outwardly from the guide bar 8.

At the other end of the cylinder and piston 9, the connection to the central post 6 may similarly be effected through a flange 26 extending outwardly from the central post 6 to a frame-side connection point 27. This frame-side connection point 27 is located rearwardly of the joint 7 in the sense that it is positioned rearwardly of a transverse plane 28 passing through the center of rotation 29 of the joint 7. The object of selecting such a location for the connection point 27 is to ensure that extension and contraction of the piston 9 will cause the guide bar 8 to swing horizontally in space.

Seen from the front view in FIG. 5, the frame-side connection point 27 of the cylinder and piston 9 to central post 6 is shown to be located at a point which is above the horizontal plane 30 of the center of rotation 29 of the joint 7. This position ensures that the guide bar 8 will be displaceable vertically by the cylinder and piston 9.

The positioning of the connection points 22 of the cylinder and piston 9 at its respective ends, with respect to the center of rotation 29 of the swivel joint 7 must in all events be such that extension of the cylinder and piston 9 will displace the side of the guide bar 8 to which it is attached in the forward and downward, or rearward and upwards, directions. Further, the path followed by the guide bar 8 should cause the moldboard 5 to be curled forwardly without a significant tendency to form buckling, and with minimal separation from the forward supporting side 41 of the frame 4.

In the embodiment of FIG. 2, as further shown in FIGS. 5, 6 and 7, the relative positions of the components were spaced from each other as follows:

- from the coupling 22 between the piston 9 at bracket 24 to the guide bar 8—2½ inches
- along the guide bar 8 to its center point opposite the joint 7—28 inches
- upwardly to the level of the axis of the joint 7—2½ inches
- inwardly along the axis of the joint 7 to its center of rotation—2 inches
- laterally in the horizontal plane towards the outer edge 32 of the moldboard 5 (best seen in FIG. 2) to a point in the vertical plane containing connection point 27—6½ inches
- upwardly to the plane of the frame-side connection point 27—2 inches
- rearwardly, to the connection frame-side connection point 27—3 inches In this preferred embodiment, the following further dimensions were employed:

- length of the cylinder and piston 9 between its connection points 22
  - fully extended—25½ inches
  - fully contracted—27½ inches
  - intermediate "reversible position"—26½ inches
- length 27 of guide bar 8—114 inches
- distance over the moldboard surface from the bottom to top edge 10, 10*a*—36 inches
- height of the bottom edge 10*a* above the ground—18 inches These approximate dimensions have been found to provide the conditions of curvature for the moldboard next described.

Figure 8A:
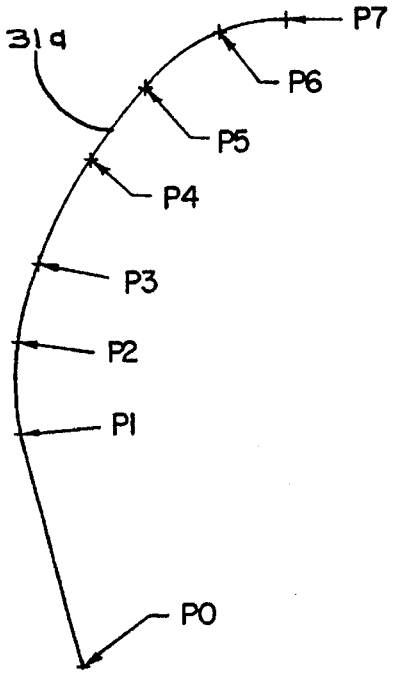
FIGS. 8*a*, 8*b* and 8*c* are tracings of the shape of the edge of the moldboard in various contours.
Figure 8B:
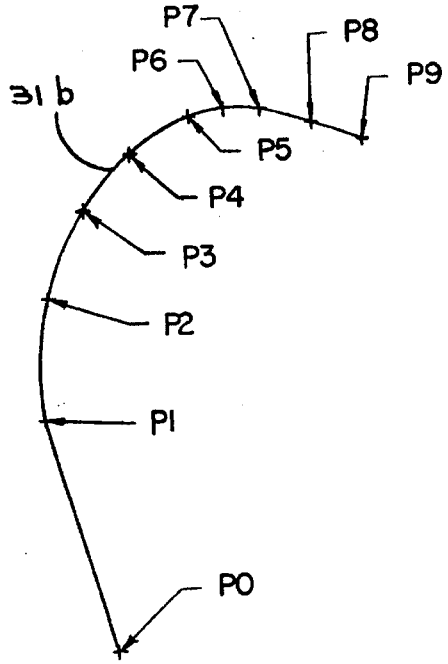
Figure 8C:
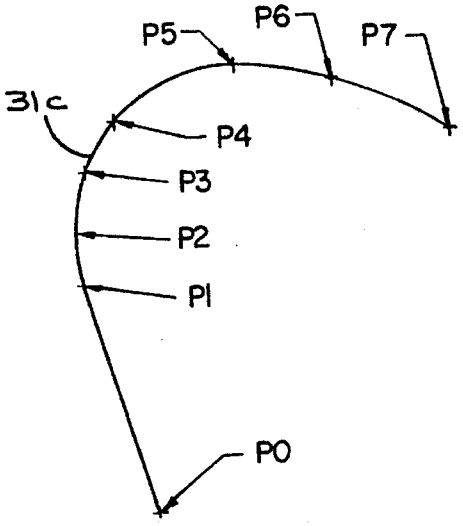

In FIGS. 8*a*, 8*b* and 8*c* a series of tracings 31*a,b,c* of the preferred shapes that the left outer edge 32 of the moldboard 5 may assume are shown. The points P-1 to P-7 represent random sampling locations along the side edge 32 of the moldboard proceeding upwardly from its lower edge 10*a* (P-1) to the upper edge 10 of the moldboard 5 (at P-7). The point P-0 is the end of the tripping blade 21 where it contacts the road.

FIG. 8*a* shows the line of the edge 32 with the nearby left end of the guide bar 8 elevated and drawn backwardly, as when the cylinder and piston 9 carried on the same side are fully contracted. This represents one of the two fully one-way configurations.

FIG. 8*b* shows the path of the edge 32 when the cylinder and piston 9 are partially extended, the guide bar 8 is neutrally aligned transversely to the direction of intended motion 33 of the vehicle 1, and the moldboard 5 is oriented in the traditional reversible plow symmetrical format.

FIG. 8*c* shows the end tracing of edge 32 with the piston 9 fully extended, the associated end of the guide bar 8 fully depressed and advanced, and the moldboard 5 in the opposite reversible format to FIG. 8*a*.

Figure 4:
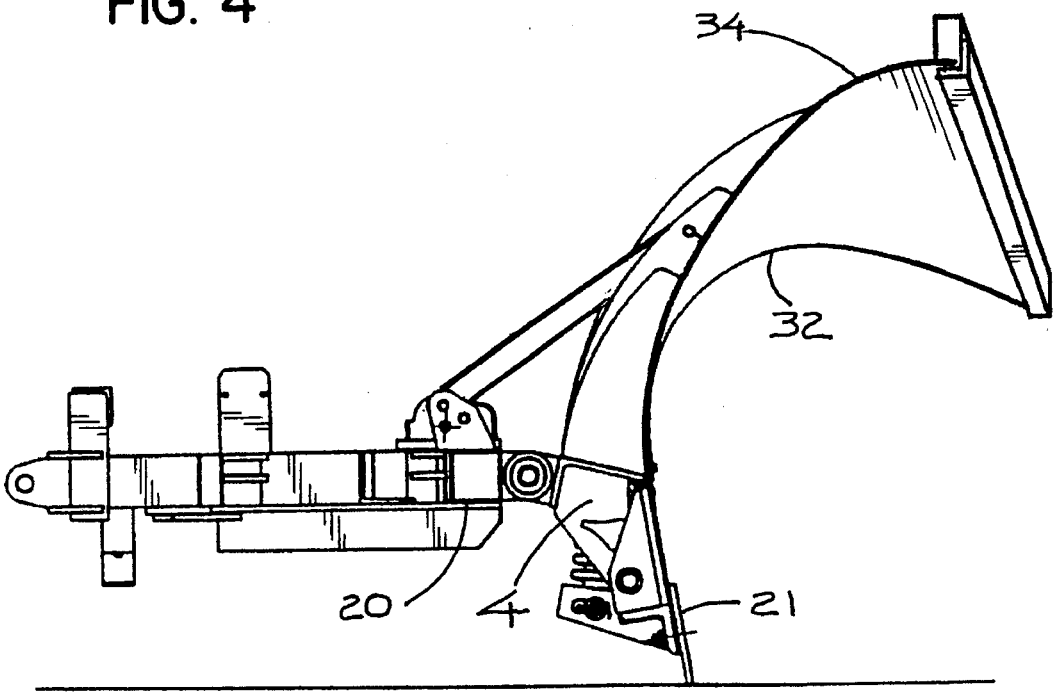
FIG. 4 is a side view of the plow in a right-hand one-way format, omitting the hydraulic cylinders.

FIG. 3 is a side view of the plow 2 in the reversible format corresponding to FIG. 8*b*. FIG. 4 is a side view of the plow 2 in the one-way format wherein the far edge 32 follows the path of FIG. 8*c*, and the near edge 34 is in the position of FIG. 8*a*.

Throughout the full range of these deformations, the moldboard 5 is contained between the longitudinal slot 11 on the guide bar 8, the forward side 41 of the frame 4 and the lower edge support 24 on the frame 4. The moldboard 8 is preferably displaced through these deformations without buckling by providing the forward side 41 of the frame 4 with a shape that conforms with the natural shape that the moldboard 5 would assume when at its most upright limit (without buckling being present), by reason of its containment by support provided at its back side 5*b* and upper and lower edges 10, 10*a*.

Following these criteria, the forward facing side 18 of the central post 6 may have either a shape which conforms to the natural shape of the moldboard 5 along at least its lower half portion, when in its one way format (FIG. 8*a*); or that which conforms to the reversible format (FIG. 8*b*). By selection of a narrow width for the central post 6, the former shape is sufficient to provide support without inducing buckling when either of the one-way formats (FIGS. 8*a*, 8*c*) are assumed.

The frame 4, according to this criteria, is separated from the moldboard 5 by a gap 36 that occurs when the adjacent moldboard surface 5b is bent forwardly. It is desirable to minimize this gap 36, while still avoiding buckling when the moldboard 5 is fully extended in its most upright position. In this manner, the frame 4 will provide the maximum support for the moldboard 5 when the moldboard 5 is receiving the thrust of a heavy weight of snow while plowing.

The geometry for a single cylinder and piston 9 has been provided. When two such units are used with the joint 7 as described, the second one should preferably be symmetrically disposed about the central post 6. This will tend to balance the forces applied to the guide bar 8.

It will be seen that such pistons 9 should not be independently adjustable, but should move in a complementary fashion, i.e. when one is extending, the other should be contracting.

If a single piston 9 is used, it must be double-acting. If two are used, it is preferable that they be double-acting in order to apply balanced forces to the guide bar 8 on both sides although this is not essential. In both cases it is desirable to provide spring-loaded locking valves 43 that will stiffen the pistons 9 once they are in position and permit the pistons 9 to serve as bracing struts, once the guide bar 8 has been placed in position.

If a single cylinder and piston 9 is employed with the above configuration and joint 7, it would be advantageous to displace the joint 7 laterally, to provide symmetrical support for the guide bar 8.

Figures 10, 10A:
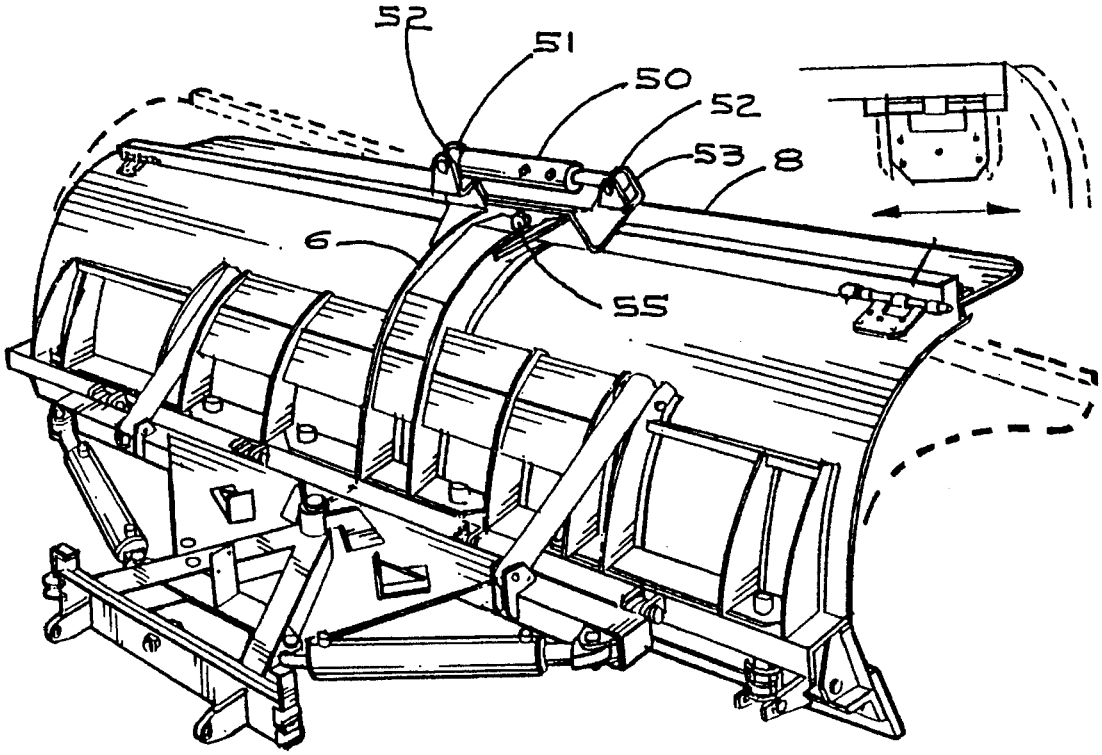
FIG. 10 is a perspective view of an alternate single-piston variant on the snow plow of the invention.
FIG. 10*a* is a detail of the sliding hinge of FIG. 10.

An alternate configuration employing a single piston is shown in FIG. 10.

In FIG. 10, piston 50 is anchored at one end 51 to the central post 6 through the bracket 52. At the other end it is attached to a bracket 53 extending upwardly from the guide bar 8.

Figure 11:
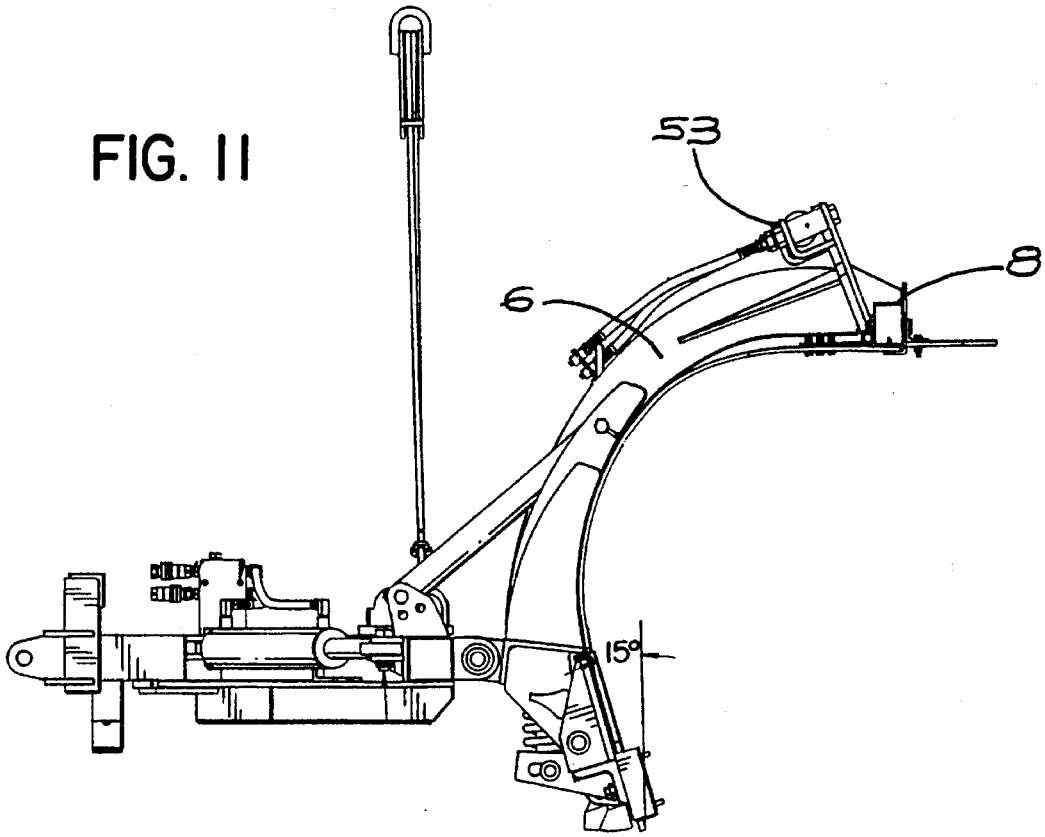
FIG. 11 is a side view of the snow plow of FIG. 10.
Figure 12:
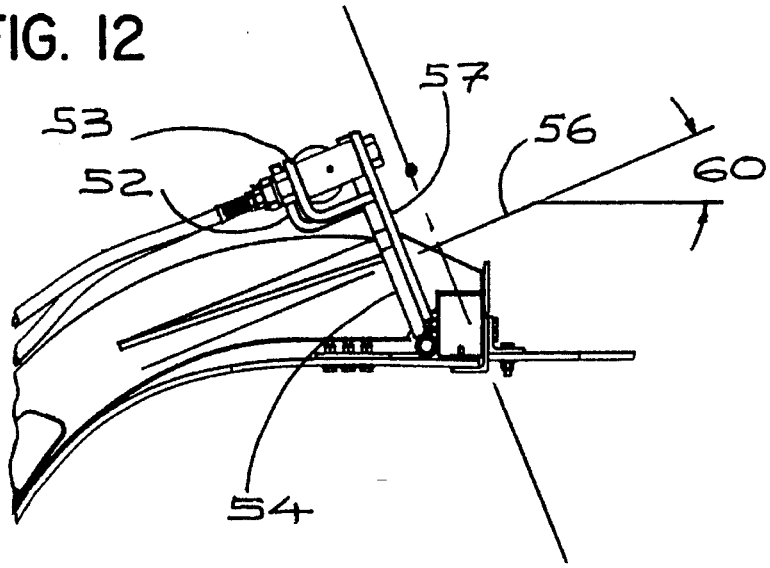
FIG. 12 is an enlarged cross-sectional view of the detail of the swivel system of the snow plow shown in FIG. 11.

As seen in FIGS. 11 and 12 the bracket 52 extends from a plate 54 through the center of which passes a bolt 55 (shown only in FIG. 10). The bolt 55 is aligned with a rotational axis 56, shown in FIG. 12.

The bracket 53 is also attached to a plate 57 which overlies the plate 54 and has a bolt-hole 58 formed therein to receive the bolt 55. These two plates 54, 57 are mounted for sliding rotation contact between their opposed surfaces.

The angle of inclination 60 of the axis 56 is chosen to cause the ends of the guide bar 8 to simultaneously swing forwardly and downwardly; or upwardly and rearwardly. A preferred orientation for the axis 56 and angle 60 to create this effect is 22½ degrees above the horizontal.

Figure 13:
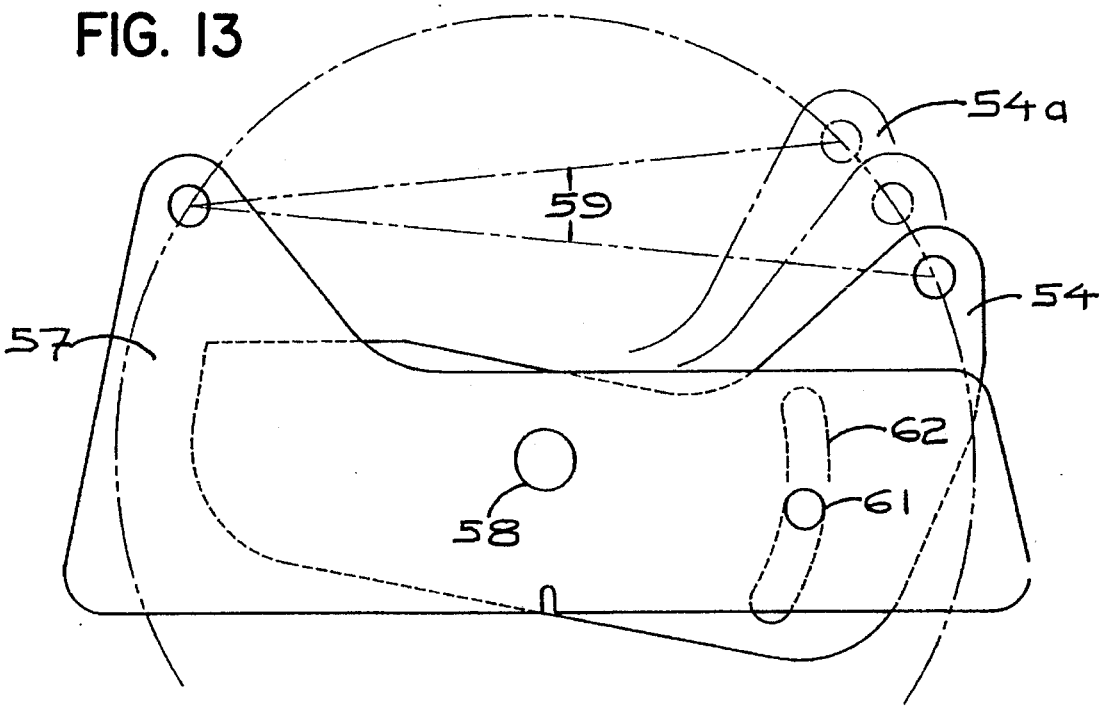
FIG. 13 is a plan view of the two plates that engage in contact action in the snow plow of FIGS. 10–12.

The action of displacing the guide bar 8 arises from the expansion and contraction of the piston 50 between the brackets 52 and 53. A tilting range 59 of 20° degrees has been found to be produced by an extension of the piston 50 to change the distance between the brackets 52, 53 from 16⅞" to 19⅛. This range of movement 59 of plate 54 from one limit to its other limit shown as plate 54*a* is shown in FIG. 13 (wherein an optional index pin 61 in a slot 62 provides a limit to the degree of displacement that can occur). Corresponding vertical and horizontal displacements of 20" and 8" are thereby produced at the ends of a 114" long guide bar 8.

Thus, an alternate configuration for reconfiguring the contour of a moldboard by means of a control device anchored in a snow plow frame has been demonstrated.

CONCLUSION

The foregoing has constituted a description of specific embodiments showing how the invention may be applied and put into use. These embodiments are only exemplary. The .invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

We claim:

1. A moldboard assembly for a reversible snow plow comprising:

(a) a supporting frame for a moldboard having:

(i) a lower moldboard support for mounting a moldboard by its lower edge on the forward side of such frame; and (ii) a central, elevated support post extending upwardly within said supporting frame;

(b) a deformable moldboard, in the form of a resilient, flexible sheet having forward and rearward surfaces and upper and lower edges, such moldboard being mounted on such frame with the lower edge of the moldboard positioned along the lower moldboard support;

(c) a guide bar positioned along the upper portion of the moldboard for supporting and aligning the upper edge of the moldboard:

(d) Joint means connecting the guide bar to the central support post to permit the guide bar to swing in both the horizontal and vertical directions;

(e) extensible guide bar positioning means connected to and extending from the guide bar to the supporting frame for the moldboard whereby the actuation the guide bar positioning means will advance and depress one end of the guide bar towards a lower limiting position while simultaneously raising and retiring the other end of the guide bar towards an upper limit so as to deform the shape of the moldboard surface.

2. A moldboard assembly as in claim 1 wherein the extensible guide bar positioning means connects to the frame at a point on the central support post.

3. A moldboard assembly as in claim 2 wherein the guide bar positioning means comprises two hydraulically activated pistons disposed symmetrically about the central support post.

4. A moldboard assembly as in claim 2 wherein said frame comprises a moldboard backup support with a forward face surface positioned along the rearward surface of at least the lower portion of the moldboard, the forward face surface of such backup support conforming to the shape naturally taken by the rearward surface of the moldboard when the guide bar is elevated to its upper limit.

5. A moldboard assembly as in claim 4 wherein the guide bar is limited by the orientation of the guide bar positioning means to swing along a path which causes the moldboard to deform without buckling, and to separate from the backup support to the minimum extent consistent with the avoidance of buckling.

6. A moldboard assembly as in claim 2 wherein the central support post is provided with a central moldboard support surface that contacts the rearward surface of the moldboard and conforms in shape tot he shape naturally taken by the rearward surface of the moldboard as it contacts the central post when an end of the guide bar is elevated to its upper limit.

7. A moldboard assembly as in claim 1 wherein the guide bar comprises:

(a) a longitudinal slot into which the upper edge of the moldboard is interfitted; and (b) a pair of hinges connecting the moldboard to the guide bar at the respective outer ends of the guide bar, such hinges providing for lateral movement of the moldboard within the longitudinal slot.

8. A moldboard assembly as in claim 1 wherein the central support post is provided with a central moldboard support surface that contacts the rearward surface of the moldboard and conforms in shape to the shape naturally taken by the rearward surface of the moldboard as it contacts the central post when the guide bar is horizontal.

9. A moldboard assembly as in claim 1 wherein said moldboard is contained between said lower moldboard support and said guide bar without being fastened to such moldboard support and guide bar.

10. A moldboard assembly as in claim 1 wherein said joint means permits rotation about a single axis only, such axis being elevated above the horizontal.

11. A moldboard assembly as in claim 1 wherein said joint means permits rotation over a range of substantially intersecting axes.

12. A moldboard assembly for a reversible snow plow comprising:

(a) a supporting frame for a moldboard having:

(i) a lower moldboard support for mounting a moldboard by its lower edge on the forward side of such frame; and (ii) a central, elevated support post extending upwardly within said supporting frame;

(b) a deformable moldboard, in the form of a resilient, flexible sheet having forward and rearward surfaces and upper and lower edges, such moldboard being mounted on such frame with the lower edge of the moldboard positioned along the lower moldboard support;

(c) a guide bar positioned along the upper portion of the moldboard for supporting and aligning the upper edge of the moldboard;

(d) joint means connecting the guide bar to the central support poet to permit the guide bar to swing in both the horizontal and vertical directions said joint means having a single axis of rotation only;

(e) extensible guide bar positioning means connected to and extending from the guide bar to the supporting frame for the moldboard whereby the extension of the guide bar positioning means will advance and depress one end of the guide bar towards a lower limiting position while simultaneously rating and retiring the other end of the guide bar towards an upper limit so as to deform the shape the moldboard surface.

13. A moldboard assembly as in claim 12 wherein the single axis of rotation of the joint means is elevated above the horizontal plane.

14. A moldboard assembly as in claim 13 wherein the extensible guide bar positioning means connects to the frame at a point on the central support post.

15. A moldboard assembly as in claim 14 wherein the quids bar positioning means comprises only one hydraulically activated piston.

16. A moldboard assembly as in claim 13 wherein the guide bar positioning means comprises only one hydraulically activated piston.

* * * * *